US007141761B1

(12) United States Patent
Dirubio et al.

(10) Patent No.: US 7,141,761 B1
(45) Date of Patent: Nov. 28, 2006

(54) PRINTING DEVICE HEATING ELEMENT AND METHOD OF USE THEREOF

(75) Inventors: Christopher A. Dirubio, Webster, NY (US); Donald M. Bott, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 63 days.

(21) Appl. No.: 11/142,302

(22) Filed: Jun. 2, 2005

(51) Int. Cl.
*G03G 15/20* (2006.01)

(52) U.S. Cl. ..... 219/216; 219/553; 399/330; 399/336; 392/417

(58) Field of Classification Search ..... None
See application file for complete search history.

(56) References Cited

U.S. PATENT DOCUMENTS 6,611,085 B1 * 8/2003 Gee et al. ..... 313/271
6,869,330 B1 * 3/2005 Gee et al. ..... 445/50
2004/0101010 A1 * 5/2004 Asatsuma et al. ..... 372/45
2005/0090812 A1 * 4/2005 Shadduck ..... 606/2
2006/0071582 A1 * 4/2006 Sakaue et al. ..... 313/112

OTHER PUBLICATIONS

"Revolutionary tungsten photonic crystal could provide more power for electrical devices"; Sandia National Laboratories; Jul. 7, 2003; http://www.sandia.gov/news_center/news_releases/2003/other/plank-Lin.html.

* cited by examiner

*Primary Examiner*—Joseph Pelham
(74) *Attorney, Agent, or Firm*—Oliff & Berridge, PLC

(57) ABSTRACT

A printing apparatus may include a heating element with at least one of a contact fuser, a radiant fuser, a substrate preheater, an image bearing member heater, and a transfuser, the heating element including a lattice of filaments wherein the filaments are separated from each other by a spacing and the spacing is such that an energy input into the heating element is radiantly output in a specific frequency band. A method of using a printing apparatus may include providing a heating element that is part of the printing device and that includes a lattice of filaments wherein the filaments are separated from each other by a spacing and the spacing is such that an energy input into the lattice is radiantly output in a specific frequency band, and performing at least one printing operation.

19 Claims, 10 Drawing Sheets

PRINTING DEVICE HEATING ELEMENT AND METHOD OF USE THEREOF

BACKGROUND

The vast majority of heating elements in xerographic fusers, substrate pre-heaters, and solid-ink transfuse systems are conventional tungsten/halogen bulb devices, which have approximately a 3000 K color temperature.

Photonic crystals have already been developed as indicated in, for example, Reference 1 ("Revolutionary tungsten photonic crystal may provide more power for electrical devices," Sandia National Laboratories, Jul. 7, 2003 (http://www.sandia.gov/news_center/news_releases/2003/other/plank-Lin.html)), which is incorporated herein by reference in its entirety. These photonic crystals have properties interesting and valuable to heating in the xerographic and solid-ink devices mentioned above.

For example, when heated with an electric current, they emit very intense radiation within a narrow band of Infrared (IR) wavelengths. The wavelengths may be tuned by altering the size of the rods and the spacing between them. The larger the dimensions, the longer the wavelength. The emissions in these tuned bands are ten times more intense in the IR than expected by traditional physics (black body radiation), and light emitters made from these photonic crystals may radiate at a 60% efficiency (conversion of electrical energy to IR radiation) compared to 8% efficiency for ordinary light bulbs and 25% for (low intensity) LEDs.

Finally, these photonic crystals may absorb broadband thermal radiation and reemit the energy in narrow bands, and the devices appear to violate Plank's blackbody radiation law.

SUMMARY

Various exemplary implementations provide a printing apparatus that includes at least a heating element that comprises at least one of a contact fuser, a radiant fuser, a substrate and/or image bearing member preheater, and a transfuser, the heating element comprising a lattice of filaments, wherein the filaments are separated from each other by a spacing and the spacing is such that an energy input into the heating element is output in a specific frequency band.

Exemplary methods of using a printing apparatus may include providing a heating element that is part of the printing device and that comprises a lattice of filaments or rods, wherein the filaments are separated from each other by a spacing, and the spacing is such that an energy input into the lattice is output in a specific frequency band, and performing one or more printing operations.

Exemplary printing systems may include a controller and a heating element that comprises a lattice of filaments, wherein the filaments are separated from each other by a spacing, and the spacing is such that an energy input into the lattice is output in a specific frequency band, the controller controlling an operation of the printing device to perform one or more printing operations.

These and other features and advantages are described in, or are apparent from, the following detailed description of various implementations of systems and methods.

BRIEF DESCRIPTION OF THE DRAWINGS

Various exemplary implementations of systems and methods will be described in detail, with reference to the following figures, wherein.

DETAILED DESCRIPTION OF EMBODIMENTS

Figure 1:
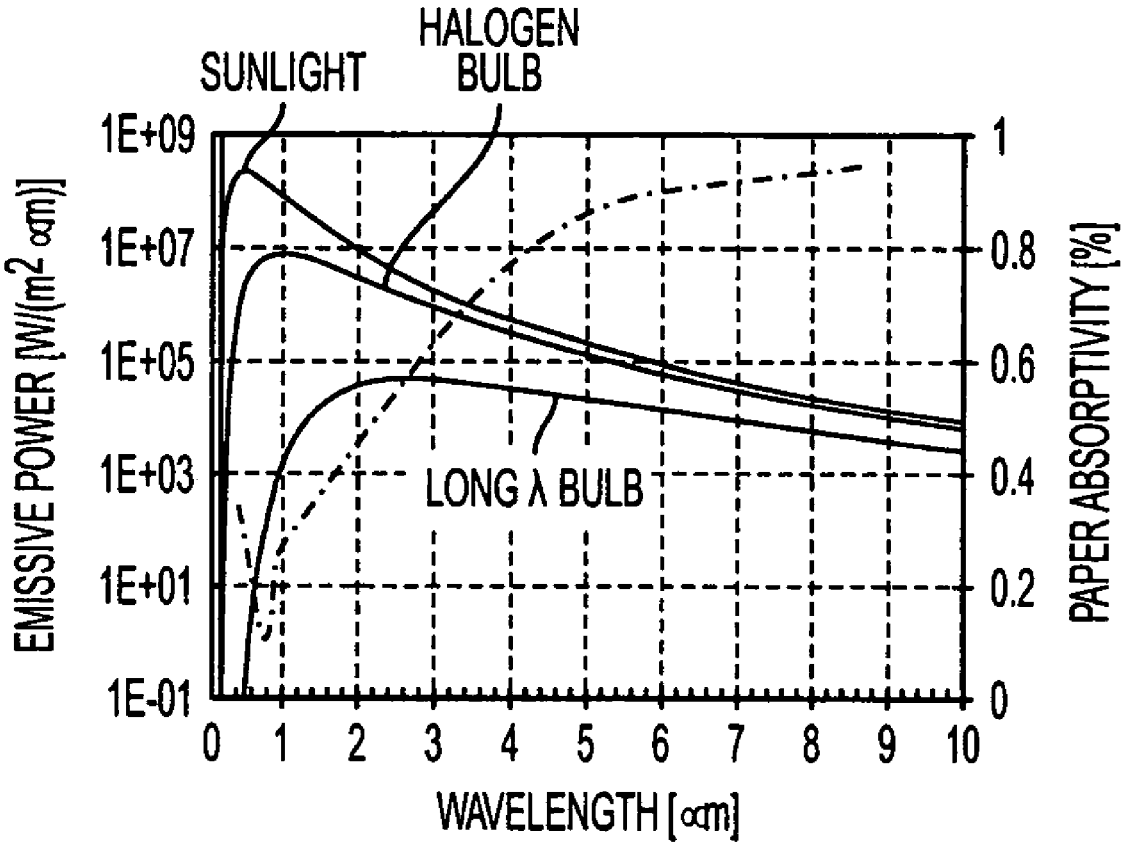
FIG. 1 is an exemplary curve illustrating black body radiation and paper absorptivity as a function of its wavelength.

FIG. 1 is a curve illustrating black body radiation curve and paper absorptivity. In FIG. 1, a tungsten-filament halogen bulb, like that used in the vast majority of transfuse, fusing, and radiant preheating systems, has a peak energy output at wavelengths in the visible and near-infrared range. Also shown in FIG. 1 is white paper absorptivity, which is very low over the visible wavelengths, and does not rise to over about 0.8 until roughly 4 μm wavelengths. Because of these low absorptivities in the infrared region, it is therefore difficult to radiantly transfer energy to paper and similar materials. Unless the emissions characteristics of the heater and the absorptivity characteristics of the heated member can be matched to one another, the efficiency of energy transfer is low.

Heating paper with these high-temperature sources is therefore quite inefficient, as a large fraction of the emitted energy is simply reflected away by the paper. In addition to increasing the energy costs of the device, this waste energy is difficult to contain or re-claim, and extra cost and effort is required to dispose of the waste energy, by, for example, large cooling fans, water-cooling, air-conditioning, and the like.

Lower-emission temperature devices whose peak emissions occur at lower wavelengths exist, such as, for example, the long-wavelength bulb shown in FIG. 1. However, as seen in FIG. 1, total energy output of these devices, because they follow Planck's Law, can be orders of magnitude lower than the short-wavelength tungsten/halogen heating elements. Heating devices using such low-wavelength elements must therefore be substantially larger than high-color-temperature tungsten/halogen bulbs.

A heating device that produces most of its radiation emission in wavelength ranges over which typical fusing materials (especially paper and toner) have high absorptivities would eliminate this power/wavelength/absorptivity constraint and enable more efficient and/or smaller heaters.

Figure 2:
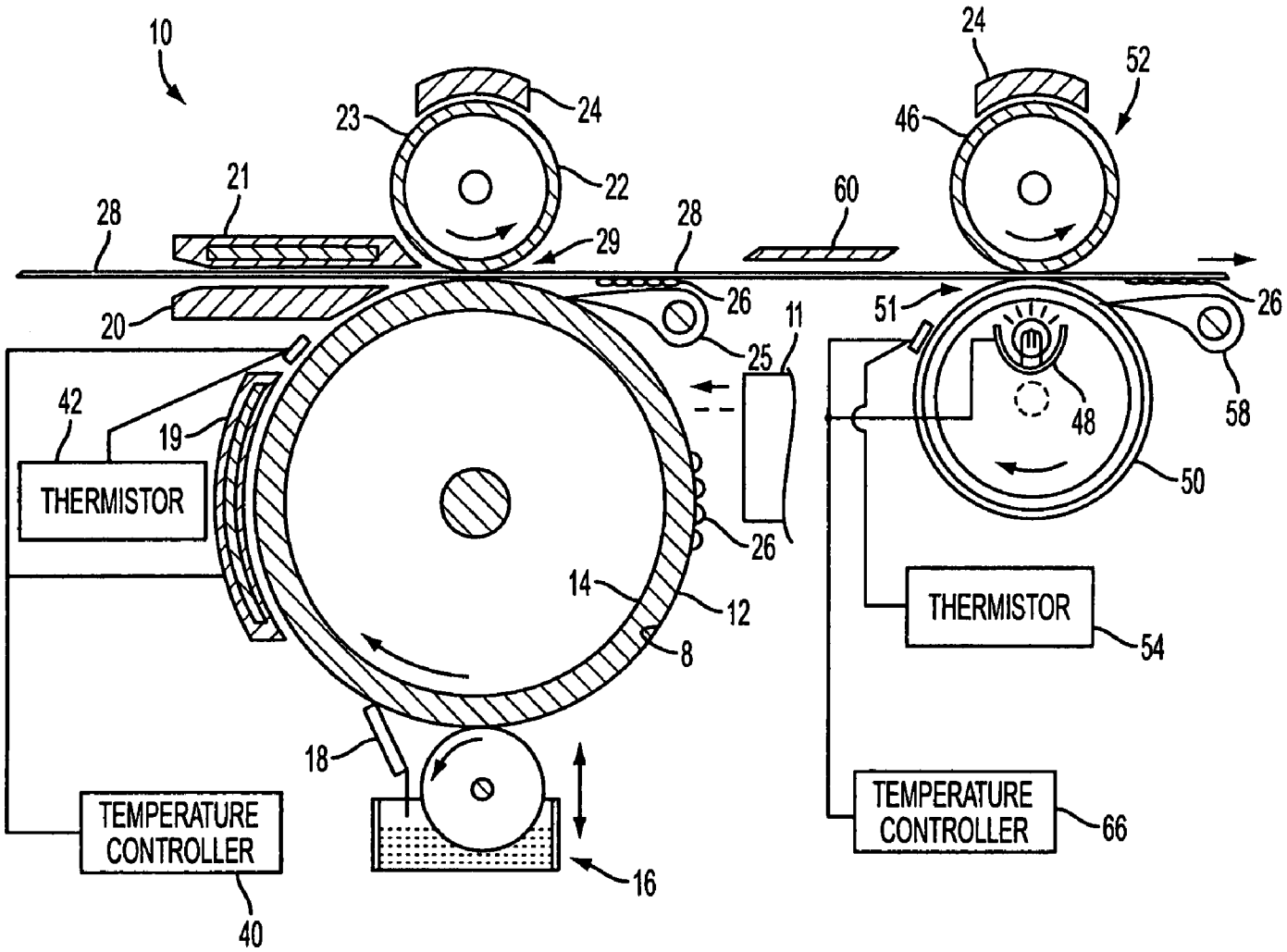
FIG. 2 CONVENTIONAL ART
FIG. 2 is a schematic illustration of an exemplary solid ink jet printer that uses hot melt inks.

FIG. 2 is a schematic illustration of an exemplary printing device 10. According to FIG. 2, the solid ink is melted in a print head 11 and delivered to a warm intermediate transfer surface 12 upon which the image is formed. The temperature of the intermediate transfer surface may be controlled by a heater 19. The substrate 28 that receives the image passes through a substrate guide apparatus 20 and 21 that may include one or more substrate pre-heaters. The substrate then enters a high pressure transfuse nip 29 where the ink image is transferred and fixed to the substrate. In this nip 29 the substrate passes between the intermediate transfer surface 12 and a roller 23 that may be heated by an external heating element 24 and/or an internal heating element (not shown). It should be noted that the roller 23 may be a drum, a belt, or some other suitable device. The substrate may then be transported to a secondary fusing device 52 to improve image quality attributes such as gloss. A substrate and image pre-heater 60 may be included in the substrate path between the transfuse nip and the secondary fuser 52. Although the secondary fuser 52 shows an internal heating element 48, an external heating element similar to 24 could also be used. The back-up roller 46 could also use either an external 24 or internal heater.

Figure 3:
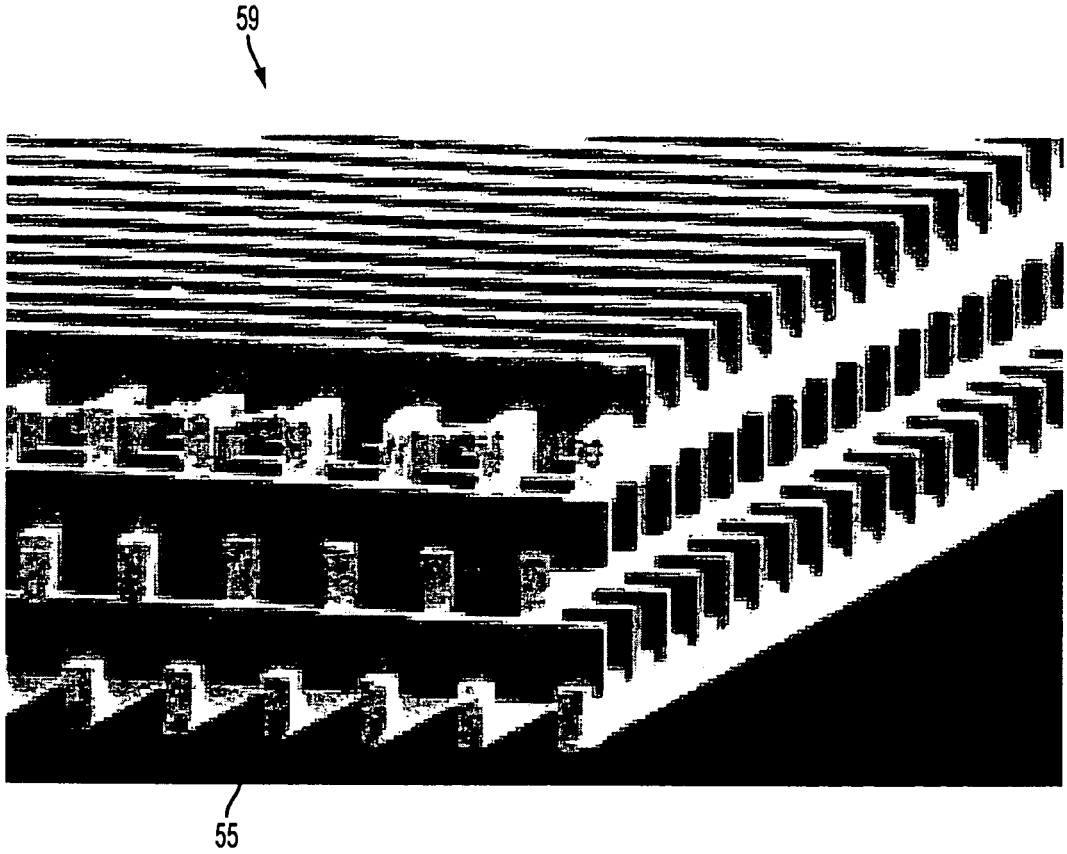
FIG. 3 is an illustration of an exemplary photonic crystal.

FIG. 3 is an illustration of an exemplary photonic crystal 59 as produced, for example, in Reference 1. In FIG. 3, the crystal has 6 layers of tungsten filaments. In this example the parallel filaments in each row are rectangular in cross-section and the filaments in alternating layers run perpendicular to the filaments in the previous layer. According to various exemplary implementations, materials other than tungsten and with cross sectional shapes other than rectangular may be used for the filaments or rods. Photonic crystals 59 may be used as high efficiency heating elements in, for example, contact fusing systems. The wavelength and bandwidth of the high intensity peak in the radiation may be selected to optimize performance by changing the internal crystal dimensions and the spacing 55 between the filaments in order to couple most efficiently with the target material. According to various exemplary implementations, the wavelength of the emitted light may be increased by enlarging the spacing between the filaments. Likewise, the wavelength of the emitted light may be decreased by reducing the spacing between the filaments.

For example, in FIG. 3 the filaments are 0.5 microns wide and are separated by 1.5 microns. These emitters emit thermal radiation over a very narrow bandwidth that may be selected by changing the photonic crystal dimensions and the spacing 55 between the filaments. The heating performance may therefore be optimized for each application. These emitters are much more efficient than conventional thermal heating elements and light bulbs in emitting radiation in the wavelengths useful to fusing, preheating, and transfuse systems. Therefore using these devices may reduce power consumption, decrease size, and/or increase performance of a given device or system. Also, both xerographic printers and solid ink printers may use contact fusers with pressured nips and/or non-contacting radiant fusers.

Figure 4:
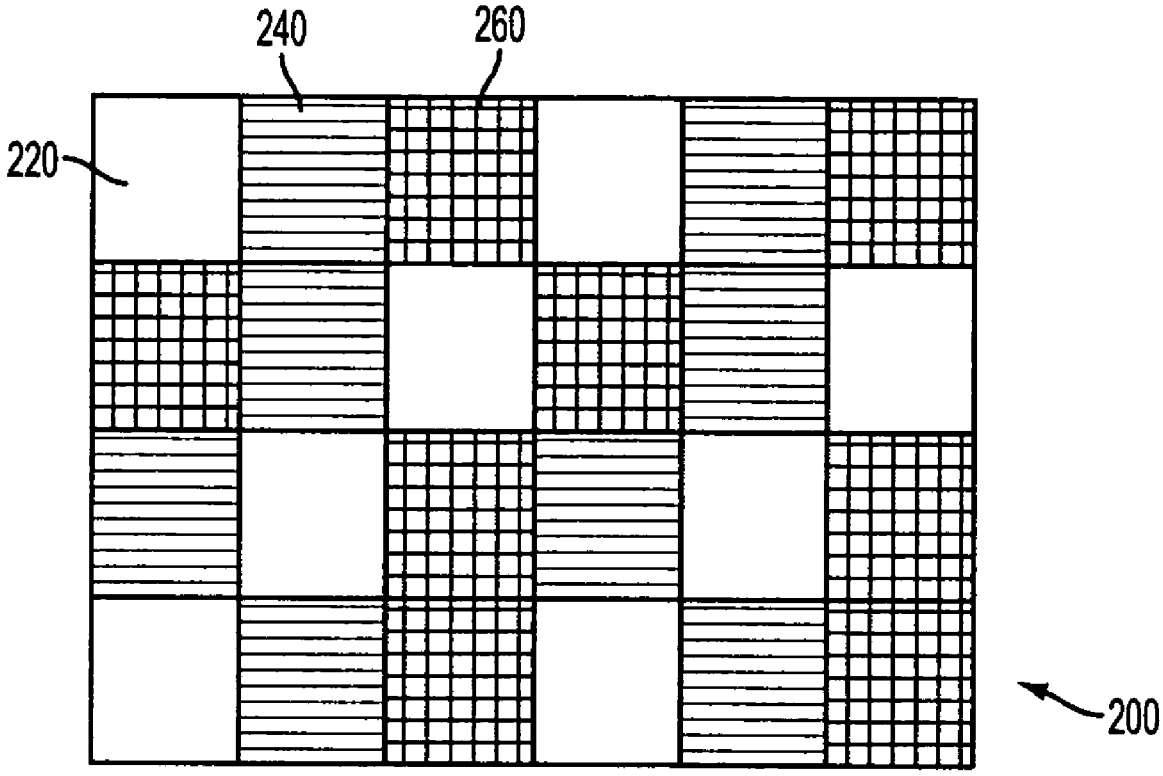
FIG. 4 illustrates an exemplary heating element consisting of an array of three types of photonic crystals.

FIG. 4 is an illustration of an exemplary array 200 of photonic crystals. Photonic crystals 220, 240 and 260 may be used in an array 200, for example, as efficient radiant fusers or substrate pre-heaters. In general, an array 200 may consist of one or more types of photonic crystals. The wavelength and bandwidth of the high intensity peak in the radiation may be selected for each crystal type in the array 200 to optimize performance by emitting at wavelengths that couple most effectively to paper or specific toners. Further, a series of sub-arrays utilizing crystals with differing internal dimensions may be used when a broad range of wavelengths is required, to fuse toners of different colors, for example. The wavelength of the absorption peak may differ for each toner that makes up a multicolor image. The array 200 of photonic crystals 220, 240 and 260 may be chosen such that it consists of crystals whose peak radiation wavelength closely matches the wavelengths of each toner's absorption peak. According to various implementations, in many of these applications, it may be desirable to use arrays 200 consisting of photonic crystals 59 with varying dimensions in order to provide high intensity radiation over a broad range of wavelengths.

Moreover, arrays 200 of photonic crystals may be used as, for example, high efficiency substrate pre-heaters, for the same reasons as discussed above. This may be used in, for example, standard xerographic fusing or transfusing applications, or in fusing or transfusing applications in solid inkjet applications.

Figure 5:
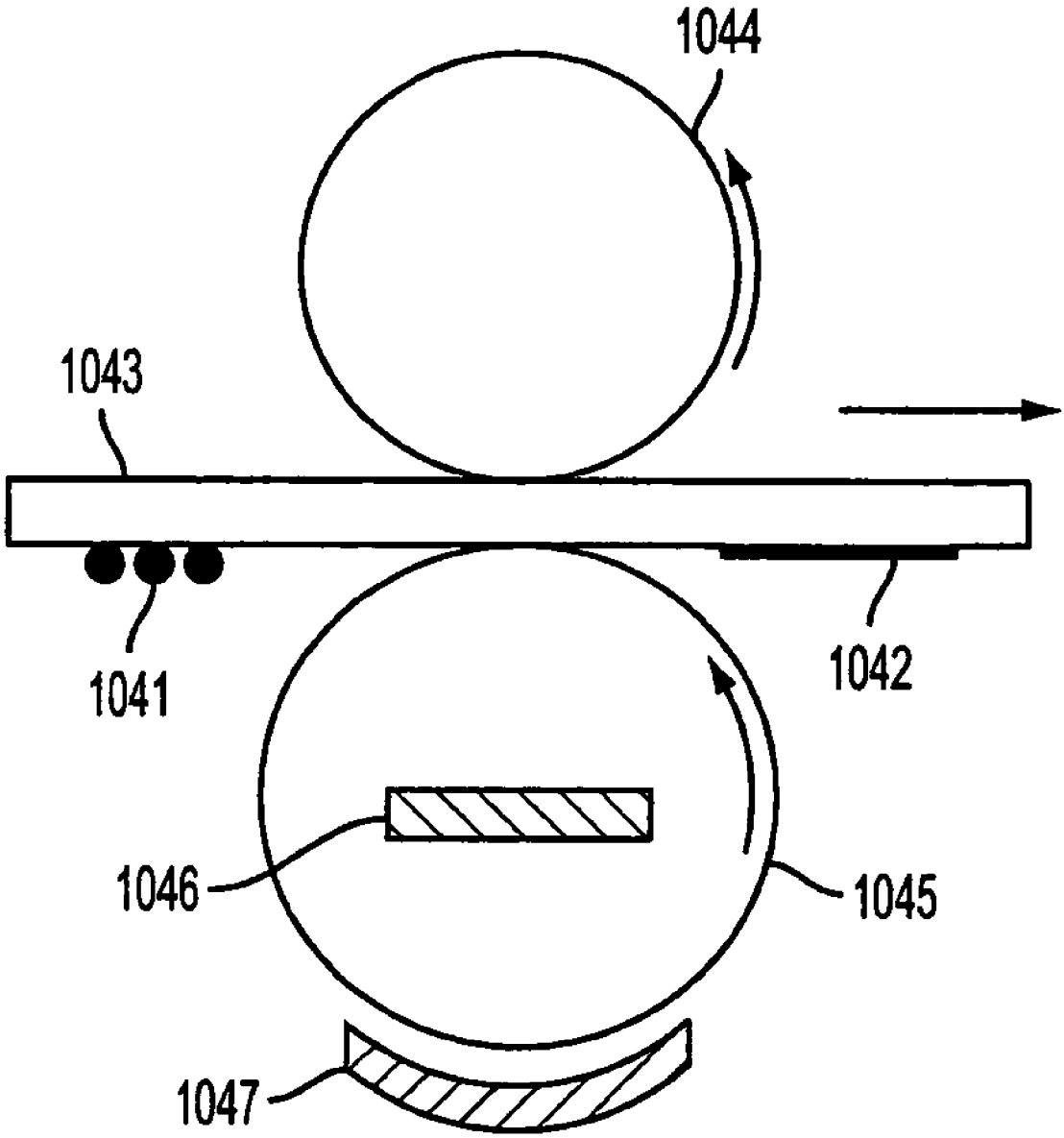
FIG. 5 is an illustration of an exemplary contact fuser or heater.

FIG. 5 is an illustration of an exemplary contact fuser or heater. In FIG. 5, the ink or toner 1041 that has not been fixed to the substrate 1043 may enter the fusing nip where it is melted and fixed 1042 to the substrate 1043. According to various exemplary implementations, the fuser 1045 and/or the pressure roller 1044 may be heated either internally, as shown in 1046, or externally, as shown in 1047 via photonic crystal heating elements. It should be noted that element 1044 may be a belt or other suitable fusing and/or pressure member. According to various exemplary implementations, the internal dimensions of the photonic crystals may be chosen to insure that the emitted radiation intensity peaks at wavelengths corresponding to wavelengths where the fusing members have high absorption.

Figure 6:
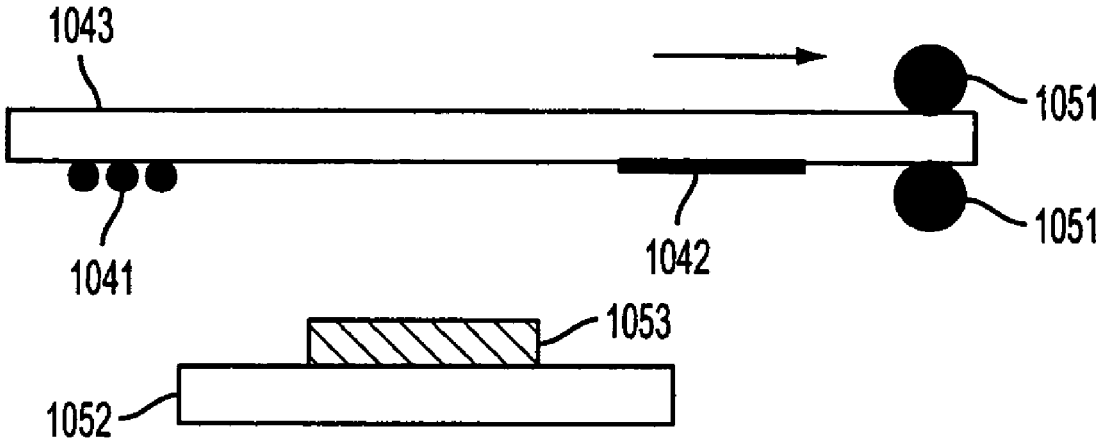
FIG. 6 is an illustration of an exemplary radiant, non-contact fuser or heater.

FIG. 6 is an illustration of an exemplary radiant, non-contact fuser or heater. According to various exemplary implementations, the ink or toner 1041 that has been transferred but not fixed to the substrate 1043 enters the fusing nip where it is melted and fixed 1042 to the substrate 1043. According to various exemplary implementations, the substrate is melted by the thermal radiation emitted by the photonic crystal heating element 1053 that is mounted to a suitable support member 1052. The substrate may be conveyed out of the fusing nip by transport rollers 1051 or by any other substrate transport mechanism. According to various exemplary embodiments, the internal dimensions of the photonic crystals are chosen to insure that the emitted radiation intensity peaks at wavelengths corresponding to wavelengths where the substrate and inks or toners have high absorption. Arrays of photonic crystals having a variety of dimensions may also be employed in the heating elements in all of the embodiments discussed here.

Figure 7:
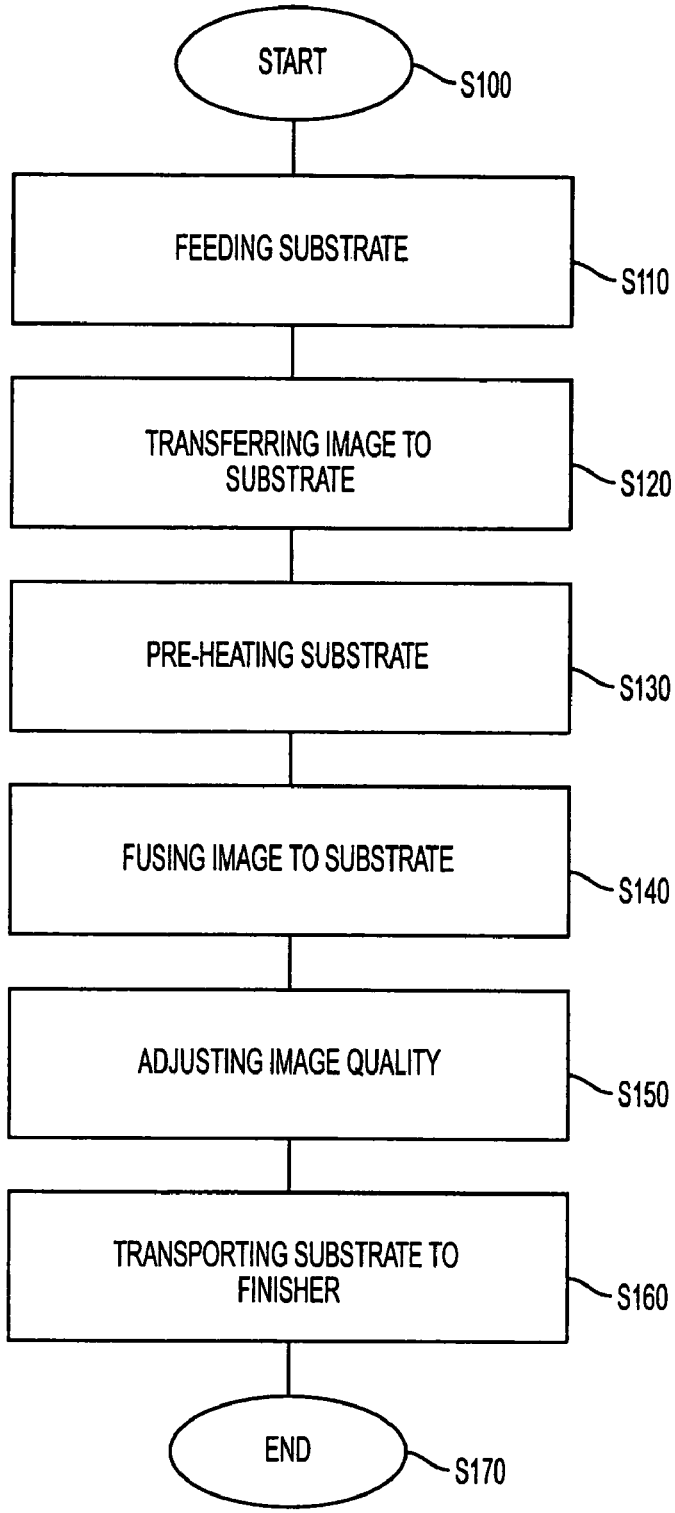
FIG. 7 is a flow chart illustrating an exemplary xerographic printing method that uses separate transfer and fusing steps.

FIG. 7 is a flow chart illustrating an exemplary xerographic printing method that uses separate transfer and fusing steps. The method starts in step S100, and continues to step S110. During step S110, substrate is fed into the printing system. Next, control continues to step S120, in which the toner is transferred from the image bearing member to the substrate. Next, control continues to step S130, in which the substrate may then be pre-heated using photonic crystal heating elements prior to fusing. Next, control continues to step S140, in which the fusing roller may be heated via photonic crystal heating elements that may be used to heat the fusing roller and/or the pressure roller. Next, control continues to step S150, in which photonic crystal heating elements may also be used in a secondary fusing step to improve image quality attributes such as, for example, gloss. Next, control continues to step S160, in which the substrate is transported to the finisher. Next, control continues to step S170, in which the method ends.

Figure 8:
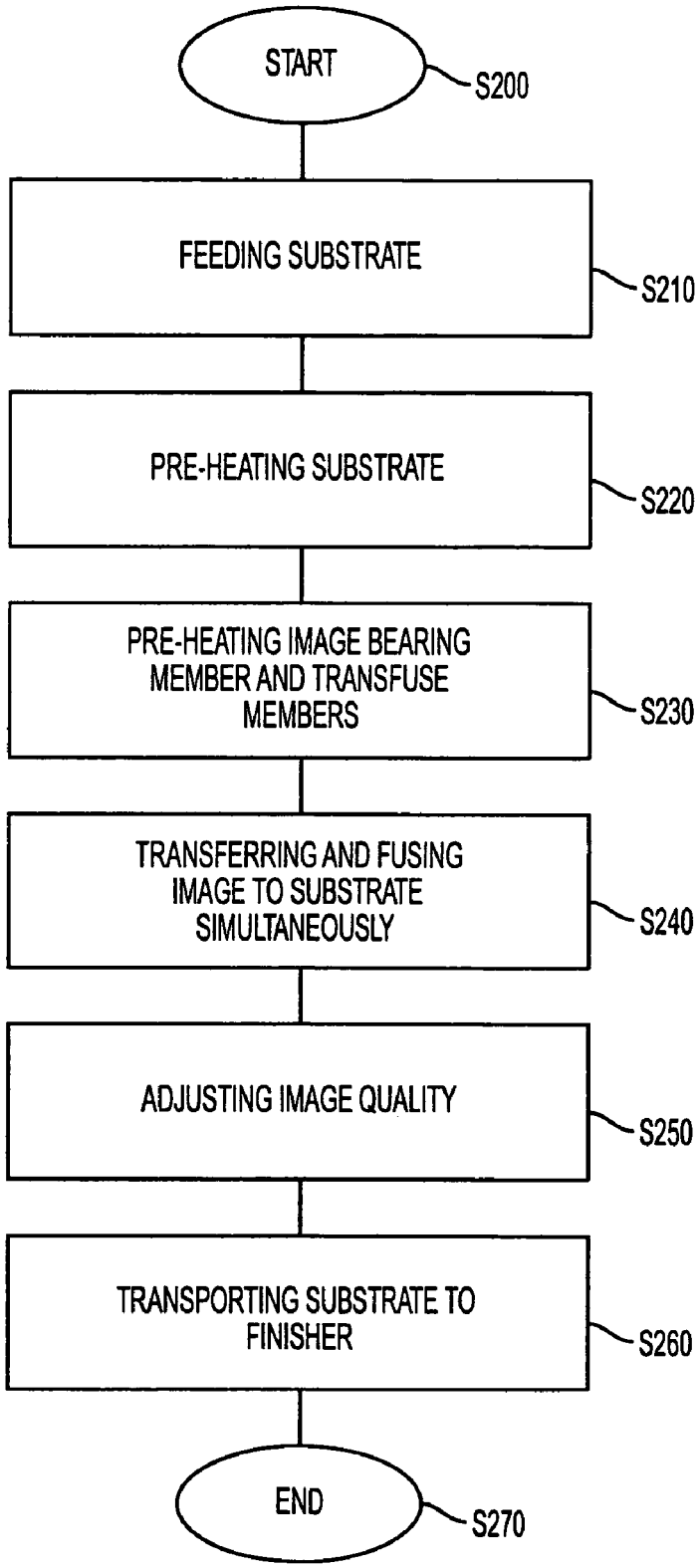
FIG. 8 is a flow chart illustrating an exemplary xerographic printing method using a single transfuse step to transfer and fix toner to a substrate simultaneously.

A xerographic printer may also utilize a transfuse step in which the toner is simultaneously transferred and fixed to the substrate. FIG. 8 is a flow chart illustrating an exemplary xerographic printing method using a single transfuse step to transfer and fix toner to a substrate simultaneously. The method starts in step S200, and continues to step S210. During step S210, the substrate is fed into the printing system. Next, control continues to step S220, in which the substrate is heated using a pre-heater with photonic crystal heating elements. Also, during step S230, photonic crystal heating elements may also be used to pre-heat both the image bearing member and the transfuse members that make up the transfuse nip. Next, control continues to step S240, in which the image is fused and transferred to the substrate simultaneously. Next, control continues to step S250, in which a secondary fusing step utilizing photonic crystal heating elements may be carried out to improve image quality attributes such as, for example, gloss. Next, control continues to step S260, in which the substrate is transported to the finisher. Next, control continues to step S270, in which the method ends.

Figure 9:
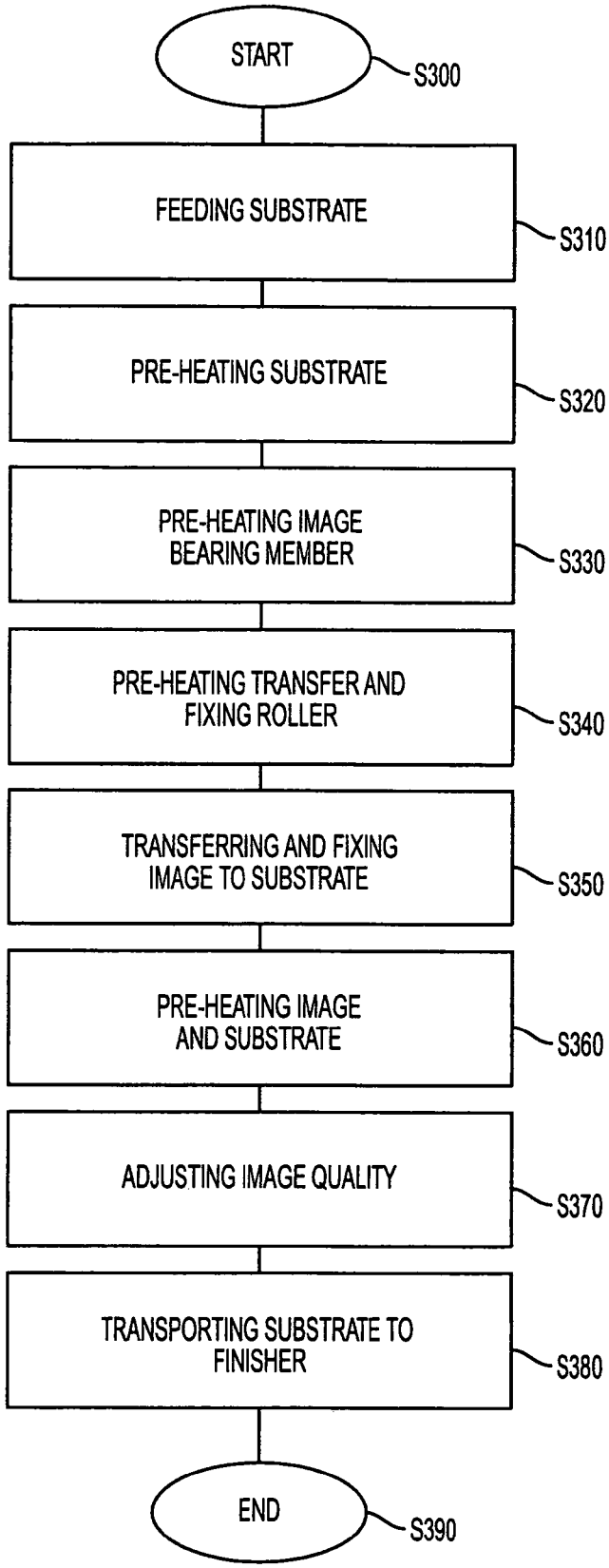
FIG. 9 is a flow chart illustrating an exemplary solid ink jet printing method using a single transfuse step to transfer and fix toner to a substrate simultaneously.

FIG. 9 is a flow chart illustrating an exemplary solid ink jet printing method using a single transfuse step to transfer and fix toner to a substrate simultaneously. The method starts at step S300 and continues to step S310, in which the substrate is fed into the printing system. Next, control continues to step S320, in which photonic crystal heating elements are used for pre-heating the substrate. Next, control continues to step S330, in which the photonic crystal heating elements are used for pre-heating the image bearing member. Next, control continues to step S340, in which photonic crystal heating elements are used for pre-heating the transfer and fixing roller. Next, control continues to step S350, the image is transferred and fused to the substrate simultaneously. Next, control continues to step S360, in which photonic crystal heating elements are used for pre-heating the image and the substrate. Next, control continues to step S370, in which the image quality is adjusted by applying heat and/or pressure the substrate in a secondary fusing step. Next, control continues to step S380, in which the substrate is transported to the finisher. Next, control continues to step S390, in which the method ends.

Figure 10:
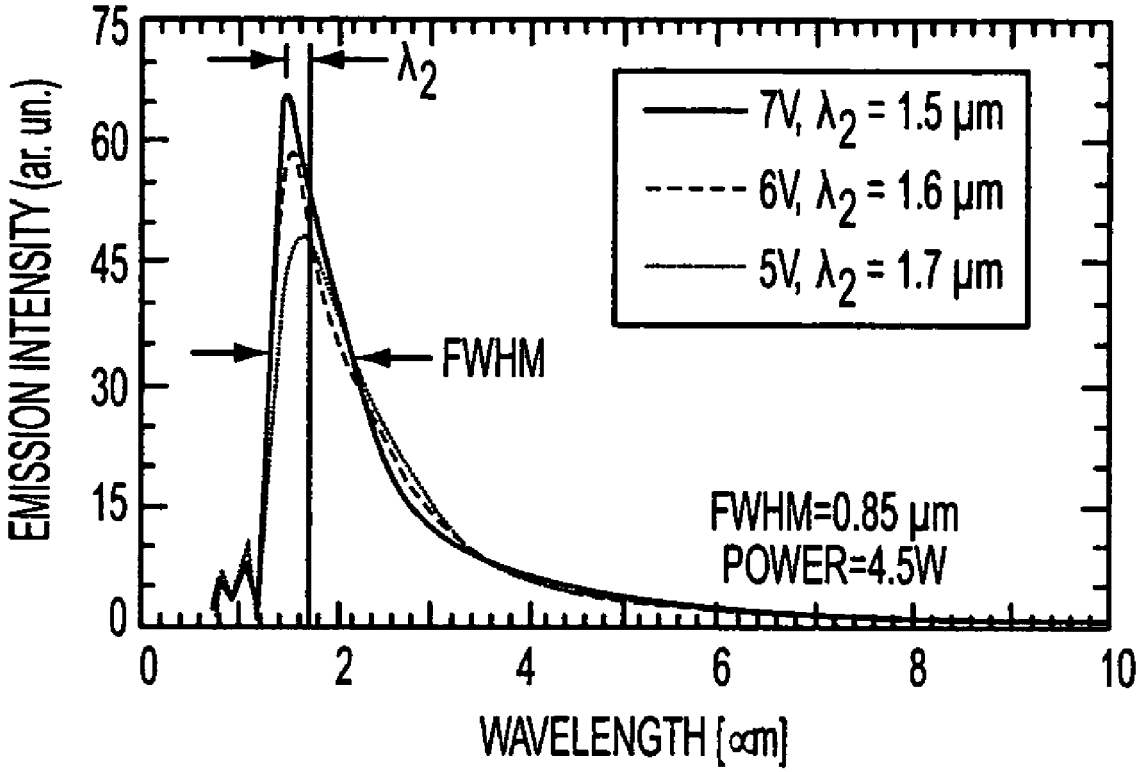
FIG. 10 is an exemplary curve illustrating the narrow emission spectrum of a photonic crystal as a function of the emission wavelength.

FIG. 10 is an exemplary curve illustrating the narrow emission spectrum of a photonic crystal as a function of the emission wavelength. In FIG. 10, the peak wavelength of a tungsten photonic crystal emitter can vary from about 5 microns to about 0.5 microns by shrinking the minimum feature size such as, for example, the width of an individual filament from about 1 micron to about 0.1 micron. At an applied voltage bias of about 7 Volts, the emission spectrum is centered at 1.5 microns with a Full Width at Half Maximum of 0.85 microns and a total power of 4.5 Watts. In contrast, a blackbody radiator at a temperature of 1500 K has a much broader emission spectrum as indicated, for example, in FIG. 1.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A printing apparatus, comprising:

a heating device that comprises heating elements, a contact fuser, a radiant fuser, a substrate pre-heater, an image bearing member pre-heater, and a transfuser;

the heating elements comprising a lattice of filaments, wherein the filaments are separated from each other by a spacing and the spacing is such that an energy input into the heating element is output in a specific frequency band.

2. The printing apparatus of claim 1, wherein the filaments are about 1–10 microns apart.

3. The printing apparatus of claim 1, wherein the filaments have a diameter of about 0.3–3 microns.

4. The printing apparatus of claim 1, wherein the filaments comprise one of at least tungsten, silicon, and any other suitable conductive material.

5. The printing apparatus of claim 1, wherein the printing apparatus comprises one of a xerographic printer, a liquid inkjet printer and a solid inkjet printer.

6. The printing apparatus of claim 1, wherein an energy conversion efficiency of the heating element is about 60% or greater.

7. The printing apparatus of claim 1, wherein the specific wavelength band is within the range of 1–10 microns.

8. The printing apparatus of claim 1, wherein the lattice is three-dimensional.

9. The printing apparatus of claim 1, wherein the lattice spacing is periodic.

10. A method of using a printing apparatus, comprising:

providing the printing apparatus of claim 1; and performing at least one printing operation using the heating device.

11. A printing system, comprising:

the printing apparatus of claim 1; and a controller;

the controller controlling the heating device to perform at least one printing operation.

12. The apparatus of claim 1, wherein the heating device comprises an array of photonic crystals, each photonic crystal comprising filaments separated from each other by a spacing such that an energy input into the photonic crystal is output in a specific frequency band for each photonic crystal.

13. Printing means, comprising:

feeding means for feeding a substrate in a marking system;

means for transferring and fusing an image to the substrate with first heating elements comprising photonic crystals; and transporting means for transporting the substrate to a finisher.

14. A marking method, comprising:

feeding a substrate in a marking system;

transferring and fusing an image to the substrate with first heating elements comprising photonic crystals; and transporting the substrate to a finisher.

15. The method of claim 14, further comprising at least one of:

pre-heating at least one of a pressure member and a fixing member with second heating elements comprising photonic crystals;

pre-heating the substrate with third heating elements comprising photonic crystals;

heating an image bearing member with fourth heating elements comprising photonic crystals; and adjusting an image quality by applying heat via fifth heating elements comprising photonic crystals.

16. The printing means of claim 13, further comprising at least one of:

heating means for pre-heating at least one of a pressure member and a fixing member with second heating elements comprising photonic crystals;

heating means for pre-heating the substrate with third heating elements comprising photonic crystals;

heating means for heating an image bearing member with fourth heating elements comprising photonic crystals; and adjusting means for adjusting an image quality by applying heat via fifth heating means.

17. The method of claim 14, wherein transferring and fusing an image to the substrate with first heating elements comprises using an array of photonic crystals, each photonic crystal comprising filaments separated from each other by a spacing such that an energy input into the photonic crystal is output in a specific frequency band for each photonic crystal.

18. The method of claim 14, wherein at least one of fusing an image to the substrate, pre-heating a pressure member, pre-heating a fixing member, pre-heating the substrate, heating the image bearing member, and adjusting an image quality of the image comprises direct radiative non-contact heating to the at least one of the substrate, the image bearing member, the pressure member and the fixing member.

19. The method of claim 14, wherein at least one of fusing an image to the substrate, pre-heating a pressure member, pre-heating a fixing member, pre-heating the substrate, heating the image bearing member, and adjusting an image quality of the image comprises indirect contact heating by first heating a component via radiative non-contact heating of the component with the heating element, then heating the at least one of the substrate, the image bearing member, the pressure member and the fixing member by contact with the component.

* * * * *